US005462829A

United States Patent [19]

Tyagi et al.

[11] Patent Number: 5,462,829

[45] Date of Patent: Oct. 31, 1995

[54] POLYMER BLENDS AND TONER COMPOSITIONS COMPRISING SAME

[75] Inventors: Dinesh Tyagi, Fairport; Louis J. Sorriero, Rochester, both of N.Y.

[73] Assignee: Eastman Kodak Company, Rochester, N.Y.

[21] Appl. No.: 171,488

[22] Filed: Dec. 21, 1993

[51] Int. Cl.[6] ..... G03G 9/087

[52] U.S. Cl. ..... 430/109; 524/505; 525/941

[58] Field of Search ..... 430/109, 110; 528/304; 524/505; 525/941

[56] References Cited

U.S. PATENT DOCUMENTS

| | | | |
|---|---|---|---|
| 3,974,078 | 8/1976 | Crystal | 252/62.1 |
| 3,985,830 | 10/1976 | Fetters et al. | 260/880 |
| 4,027,048 | 5/1977 | Crystal | 252/62.1 |
| 4,557,991 | 12/1985 | Takagiwa et al. | 430/109 |
| 4,758,506 | 7/1988 | Lok et al. | 430/903 |
| 4,814,253 | 3/1989 | Gruber et al. | 430/106.6 |
| 5,082,883 | 1/1992 | Alexandrovich et al. | 524/109 |
| 5,147,750 | 9/1992 | Nakanishi | 430/110 |
| 5,156,937 | 10/1992 | Alexandrovich et al. | 430/110 |

FOREIGN PATENT DOCUMENTS

| | | |
|---|---|---|
| 57032-447 | 2/1982 | Japan . |
| 57-176060A | 10/1982 | Japan . |
| 59147-044A | 8/1984 | Japan . |
| 63-048058 | 9/1988 | Japan . |
| 1553301 | 9/1979 | United Kingdom . |
| 2075703 | 11/1981 | United Kingdom . |

*Primary Examiner*—John Goodrow
*Attorney, Agent, or Firm*—Willard G. Montgomery

[57] ABSTRACT

Polyblends are provided which comprise (a) a major amount of a linear or branched matrix polymer comprising a polyester having a number average molecular weight of at least 2000 or a vinyl polymer having a number average molecular weight of at least 3000 and (b) a minor amount of a block copolymer of AB or ABA type wherein A is a homopolymer block which is compatible with the matrix polymer and B is a homopolymer block which is incompatible with the matrix polymer, the blend having a fusing temperature of not more than about 250° C., a melt viscosity of from about $4\times 10^2$ to $5\times10^4$ poise as measured on a Rheometrics Dynamic Analyzer at 150° C. and a frequency of 1 rad/sec and a melt elasticity of from about $1.5\times10^2$ to $4\times 10^4$ dynes/cm$^2$.

The polyblends are useful in the preparation of electrostatographic toner compositions used in electrographic processes.

18 Claims, No Drawings

POLYMER BLENDS AND TONER COMPOSITIONS COMPRISING SAME

FIELD OF THE INVENTION

This invention relates to novel polymer blends and to thermally fixable electrostatographic toner compositions containing such blends.

BACKGROUND OF THE INVENTION

Electrography, which broadly includes the forming and developing of electrostatic image patterns either with or without light, has become a major field of technology. It perhaps is best known through the use of electrophotographic office copying machines. In electrophotographic processes, a uniform electrostatic charge is placed on a photoconductive insulating layer. The layer is then exposed to a light and shadow image to dissipate the charge on the areas of the layer exposed to light. The resulting electrostatic image is developed by depositing a toner powder on the image. The toner powder is only adherently attracted to those areas of the layer which retain a charge so that the toner image corresponds to the electrostatic image when the charging polarity is opposite that of the toner polarity. Conversely, if the toner polarity is the same as the charging polarity, exposed and thus discharged areas of the image can be toned if the potential applied to the toning assembly is higher than that of the exposed areas. The toner image is then transferred to a receiver sheet typically consisting of a smooth, high quality paper such as clay coated lithographic paper stock to which it is permanently fixed thereto by thermal fusion.

Fixing of the toner image to the receiver sheet usually is accomplished by passing the sheet, on which the toner particles are deposited, through the nip of a pair of heated fusing rolls. The roll which contacts the toner usually has a resilient surface such as silicone rubber which has low adhesion to the fused toner. A desirable quality of the thermoplastic toner particles is that they include a toner binder (i.e., a polymer) that has a relatively low fusing temperature, e.g., less than about 250° C. and preferably from about 100° to 250° C. If this fusing temperature is too high, the energy requirement for the fusion step is excessive and the machine life can be reduced by the degradation effects of heat on elastomeric fusing roller materials, electronic components, and the like, and if too low the toner particles tend not to adhere to the receiver sheet. Another desirable quality of the thermoplastic toner particles is that they include a polymeric toner binder that displays a low melt viscosity e.g., in the range of from about $4\times10^2$ to $5\times10^4$ poise as measured on a Rheometrics Dynamic Analyzer at 150° C. and a frequency of 1 rad/sec. Such low melt viscosity is needed to achieve the desired fusing properties such as good surface gloss and the elimination of light scattering voids within an image, good adhesion of the toner to the sheet, good image clarity and high fusing speeds while at the same time allowing for low enough input energy or temperature such that a high quality paper receiver such as a clay coated lithographic paper stock does not blister, char or burn. Blistering is a phenomena where water within the clay coated lithographic paper stock is vaporized during the toner fusing process, causing the paper to form surface protrusions and delaminations. Still another desirable quality of the thermoplastic toner particles is that they include a polymeric toner binder that minimizes "off-setting" of individual toner particles of the developed image during the fixing operation.

Off-setting is the undesirable transfer of toner particles from the developed toner image carried on a receiving member (e.g., copy sheet) to the surface of the heated fusing member (e.g., a fuser roller). The surface of the fusing member therefore becomes contaminated with toner particles; and, upon further use of such a contaminated fusing member, it is found that these toner particles adhered to the surface of the fusing member are transferred to subsequent copy sheets or receiving members. As a result, either a ghost image of previously fixed images is formed on subsequent copy sheets, or undesirable deposits of toner material are formed in background areas of subsequent copy sheets, causing scumming or discoloration in the background areas. In addition, in some instances the copy sheet may fail to separate from the heated fusing member and, in the case of a fuser roller, for example, wrap itself around the roller. Thus, a high "hot offset" temperature, i.e., the temperature at which the cohesive strength of the toner matrix material (or binder resin) is lost and the toner thus sticks to the fusing member and causes offset, also is desirable for a toner. The difference between the "onset of fusing" temperature and the "hot offset" temperature is referred to herein as "offset latitude". The greater the offset latitude is, the wider the temperature range in which the fusing roller can operate. Resistance to offset normally is associated with high melt cohesive strength or high melt elasticity of the polymeric toner binder. Typically, this should range from about $1.5\times10^2$ to about $4\times10^4$ dynes/cm$^2$, preferably from about $5\times10^2$ .to about $4\times10^4$ dynes/cm$^2$.

A problem with many polymers which would otherwise be useful in toner compositions is that those with low enough fusing temperatures and a sufficiently low melt viscosity for good flow and adhesion to the receiver sheet, also have a low melt elasticity. As a result, portions of the toner offset onto the resilient fusing roller when the receiver sheet passes through the heated nip. The melt elasticity and, thus, the cohesiveness of the molten toner mass is so low that the fused toner mass undergoes melt fracture when the receiver sheet leaves the nip and separates from the fusing roll. Therefore, although most of the toner sticks to the receiver sheet, some of it sticks to the roller and then offsets onto the next receiver sheet passing through the nip thereby creating an offset or ghost image on that sheet. In addition to the aforementioned off-setting problem, toner binders having a low melt elasticity also exhibit narrower offset latitudes and poor keeping properties. Further, they also exhibit increased brittleness which causes the toner particles to become excessively finely divided during use in the electrostatographic copying machine where they contaminate the inside of the machine and cause a reduction in developer life.

To increase melt elasticity, a number of approaches have been taken. One approach is to crosslink the thermoplastic binder resin of the toner as disclosed in the patent to Jadwin, U.S. Pat. No. Re. 31,072. Crosslinking does reduce toner offset by increasing the cohesiveness of the melted toner but at the expense of raising the fusing temperature and melt viscosity.

Since few, if any, individual fusible polymers have the combination of desired qualities of low fusing temperature, low melt viscosity and high melt elasticity, attempts have been made to form suitable toner compositions from blends of polymers. It is usually found, however, that when a toner binder or polymer of sufficiently low fusing temperature and low melt viscosity is blended with another high molecular weight polymer to form a blend having a satisfactorily high melt elasticity, the melt viscosity of the blend is too high for satisfactory use as a toner.

Thus, further improved toner compositions are needed which at relatively low temperatures will have sufficiently low melt viscosities to flow and fix to receiver sheets, but which will have sufficiently high melt elasticities so that the toner, as it adheres to the receiver sheet, will pull away from the fusing roller and not stick to it.

BRIEF SUMMARY OF THE INVENTION

In accordance with the present invention, a novel thermoplastic polymer blend is provided which has the desired qualities for forming a non-offsetting, fusible toner composition. The blend provides an unexpected and desirable combination of properties related to the melt rheology of the blend. These include a low fusing temperature, a low melt viscosity, a high melt elasticity, wide offset latitude, reduced brittleness and good keeping properties. The polymer blend of the invention comprises a homogeneous blend of:

(a) a major amount of a linear or branched matrix polymer, the polymer being a polyester having a number average molecular weight of at least 2,000 or a vinyl polymer having a number average molecular weight of at least 3,000, and (b) a minor amount of a block copolymer of AB or ABA type wherein A is a homopolymer block which is compatible with the matrix polymer and B is a homopolymer block which is incompatible with the matrix polymer, the blend having a fusing temperature of not more than 250° C., a melt viscosity of from about $4\times10^2$ to $5\times10^4$ poise as measured on a Rheometrics Dynamic Analyzer at 150° C. and a frequency of 1 rad/sec and a melt elasticity of from about $1.5\times10^2$ to $4\times10^4$ dynes/cm$^2$.

Addition of the block copolymer to the matrix polymer increases the melt elasticity over that of the matrix polymer alone so that toner binders made therefrom give the toner particles good melt cohesive strength or high melt elasticity so that substantially all of the toner particles remain adhered to the receiver sheet during fusing. Despite the increase in melt elasticity, the melt viscosity of the toner binder particles of the present invention is maintained at a relatively low level thus permitting the use of lower fusing times and temperatures. As a result, less power is needed to bind the toner particles to the receiver sheet. Fusing temperature reduction also has the added advantage of diminishing the possibility of paper distortion and blistering.

Further, toner powders made with the polymeric blends of this invention can be heat fused at speeds of about 10 inches per second on clay coated lithographic paper stock or the like using a heated silicone rubber coated fuser roll. Thus, these toner powders can be used at high speed to produce very high quality heat fused color images on such stock.

Various other features, advantages, aims, purposes, embodiments and the like of the invention will be apparent to those skilled in the art from the present specification and claims.

DETAILED DESCRIPTION OF THE INVENTION

For purposes of this application, the definitions set forth in the following paragraphs apply.

The term "particle size", as used herein, or the term "size", or "sized" as employed herein in reference to the term "particles", means the volume weighted diameter as measured by conventional diameter measuring devices, such as a Coulter Multisizer, sold by Coulter, Inc.

The term "glass transition temperature" or "$T_g$" as used herein means the temperature at which a polymer changes from a glassy state to a rubbery state. This temperature can be determined by differential thermal analysis as disclosed in "Techniques and Methods of Polymer Evaluation", Vol. 1, Marcel Dekker, Inc., N.Y. 1966.

The term "fusing temperature" as used herein means the surface temperature of a fuser member (e.g., a fuser roller) at which images of satisfactory quality can be produced.

The term "melt viscosity" as used herein means the complex viscosity of a polymer measured at a particular melt temperature and a particular frequency of oscillation. Melt viscosity is measured on a Rheometrics Dynamic Analyzer.

The term "melting temperature" or "$T_m$" as used herein means the temperature at which a polymer changes from a crystalline state to an amorphous state. This temperature ($T_m$) can be measured by differential thermal analysis as disclosed in "Techniques and Methods of Polymer Evaluation."

The term "keep" or "keeping" as used herein in relation to a toner powder means toner that will not form a brick and remains free flowing at temperatures normally encountered in a copier or during shipping or storage.

The term "polyblend" as used herein means a physical mixture of two or more polymers.

The matrix polymer is the major component of the blend compositions of the invention, comprising at least about 80 weight percent and preferably at least about 90 weight percent of the blend. Useful matrix polymers are thermoplastic vinyl polymers including vinyl-acrylic copolymers or condensation polymers which fuse at 250° C. or below, preferably from about 100° to 250° C. and more preferably from about 110° to 150° C.

Any suitable thermoplastic vinyl polymer may be employed in the practice of the present invention, including homopolymers or copolymers of two or more vinyl monomers. Typical of such vinyl monomeric units include: styrene, p-chlorostyrene, vinylnaphthaline, mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of alpha-methylene aliphatic monocarboxylic acids such as methyl acrylate, ethyl acrylate, n-butyl acrylate, isobutyl acrylate, n-octyl acrylate, dodecyl acrylate, 2-chloroethyl acrylate, phenyl acrylate, methyl alphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidine and the like; and mixtures thereof.

Generally polymers containing relatively high percentages of styrene are preferred. The styrene resin employed may be a homopolymer of styrene, or of styrene homologs of copolymers of styrene with other monomeric groups. Any of the above typical monomeric units may be copolymerized with styrene by addition polymerization. Styrene resins also may be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired. However, non-vinyl type thermoplastic resins also may be employed such as modified phenolformaldehyde resins, oil modified epoxy resins, polyurethane resins, cellulosic resins, polyether resins, and mixtures thereof.

Especially useful resins are styrenic polymers of from 40 to 100 percent by weight of styrene or styrene homologs and from 0 to 45 percent by weight of one or more alkyl acrylates or methacrylates. Preferably, but not necessarily, this is a lower alkyl acrylate or methacrylate in which the alkyl group contains from 1 to 4 carbon atoms. Examples include methyl acrylate, ethyl acrylate, n-butyl acrylate, isobutyl acrylate, n-octyl acrylate, dodecyl acrylate, 2-chloroethyl acrylate, methyl methacrylate, ethyl methacrylate, butyl methacrylate and the like.

Particularly useful polymers are styrene polymers of from 60 to 95 percent by weight of styrene or styrene homologs such as α-methylstyrene, o-methylstyrene, p-methylstyrene, p-ethylstyrene, 2,4-dimethylstyrene, p-n-hexylstyrene, p-n-octylstyrene, p-tert-butylstyrene, p-n-nonylstyrene, p-n-phenylstyrene and the like and from 5 to 40 percent, by weight, of one or more lower alkyl acrylates or methacrylates. Fusible styrene-acrylic copolymers which are covalently lightly crosslinked with a divinyl compound such as divinylbenzene as disclosed in the aforementioned patent to Jadwin, U.S. Pat. No. Re. 31,072 also are especially useful in the practice of the present invention.

Vinyl polymers useful in the polyblends of the present invention should have a number average molecular weight of at least 3,000 and preferably from 5,000 to 50,000. Vinyl polymers suitable for use in the polyblends of the present invention also should have a glass transition temperature (Tg) of from about 50° to 100° C.

Especially useful condensation polymers in the polyblends of the present invention are amorphous polyesters having a glass transition temperature of 50° to 100° C. and a number average molecular weight of at least 2,000, preferably from about 4,000, to 20,000 prepared by reacting the usual types of polyester monomers. Also useful are crystalline polyesters having a melting temperature (Tm) of about 50° to 125° C. and a number average molecular weight of at least 2,000, preferably 4,000 to 20,000.

Monomers useful in preparing polyesters used in this invention include: 1,4-cyclohexanediol; 1,4-cyclohexanedimethanol; 1,4-cyclohexanediethanol; 1,4-bis( 2-hydroxyethoxy)-cyclohexane; 1,4-benzenedimethanol; 1,4-benzenediethanol; norbornylene glycol; decahydro-2,6-naphthalenedimethanol; bisphenol A; ethylene glycol; diethylene glycol; triethylene glycol; 1,2-propanediol, 1,3-propanediol; 1,4-butanediol; 2,3-butanediol; 1,5-pentanediol; neopentyl glycol; 1,6-hexanediol; 1,7-heptanediol; 1,8-octanediol; 1,9-nonanediol; 1,10-decanediol; 1,12-dodecanediol; 2,2,4-trimethyl-l,6-hexanediol; and 4-oxa- 2,6-heptanediol.

Suitable dicarboxylic acids include: succinic acid; sebacic acid; 2-methyladipic acid; diglycolic acid; thiodiglycolic acid; fumaric acid; adipic acid; glutaric acid; cyclohexane-1,3-dicarboxylic acid; cyclohexane-1,4-dicarboxylic acid; cyclopentane-1,3-dicarboxylic acid; 2,5-norbornanedicarboxylic acid; phthalic acid; isophthalic acid; terephthalic acid; 5-butylisophthalic acid; 2,6-naphthalenedicarboxylic acid; 1,4-naphthalenedicarboxylic acid; 1,5-naphthalenedicarboxylic acid; 4,4'-sulfonyldibenzoic acid; 4,4'-oxydibenzoic acid; binaphthyldicarboxylic acid; and lower alkyl esters of the acids mentioned.

Polyfunctional compounds having three or more carboxyl groups, and three or more hydroxyl groups are desirably employed to create branching in the polyester chain. Triols, tetraols, tricarboxylic acids, and functional equivalents, such as pentaerythritol, 1,3,5-trihydroxypentane, 1,5-dihydroxy-3-ethyl-3-(2-hydroxyethyl)pentane, trimethylolpropane, trimellitic anhydride, pyromellitic dianhydride, and the like are suitable branching agents. Presently preferred polyols are glycerol and trimethylolpropane. Preferably, up to about 15 mole percent, preferably 5 mole percent, of the reactant monomers for producing the polyesters can be comprised of at least one polyol having a functionality greater than two or polyacid having a functionality greater than two.

Variations in the relative amounts of each of the respective monomer reactants are possible for optimizing the physical properties of the polymer.

The polyesters used in this invention are conveniently prepared by any of the known polycondensation techniques, e.g., solution polycondensation or catalyzed melt-phase polycondensation; for example, by the transesterification of dimethyl terephthalate, dimethyl glutarate, 1,2-propanediol and glycerol.

The polyesters also can be prepared by two-stage polyesterification procedures, such as those described in U.S. Pat. Nos. 4,140,644 and 4,217,400. The latter patent is particularly relevant, because it is directed to the control of branching in polyesterification. In such processes, the reactant glycols and dicarboxylic acids, are heated with a polyfunctional compound, such as a triol or tricarboxylic acid, and an esterification catalyst in an inert atmosphere at temperatures of 190° to 280° C., preferably 200° to 260° C. Subsequently, a vacuum is applied, while the reaction mixture temperature is maintained at 220° to 240° C., to increase the product's molecular weight.

One presently preferred class of polyesters comprises residues derived from the polyesterification of a polymerizable monomer composition comprising;

a dicarboxylic acid-derived component comprising:

about 75 to 100 mole percent of dimethyl terephthalate and about 0 to 25 mole percent of dimethyl glutarate and a diol/polyol-derived component comprising:

about 90 to 100 mole percent of 1,2-propane diol and about 0 to 10 mole % of glycerol.

Useful matrix polymers or resins have fusing temperatures in the range of about 100° to 250° C. so that the toner particles can readily be fused after development. Preferred are resins which fuse in the range of about 110° to 150° C. It has been found that the addition of the block copolymer to the matrix polymer does not significantly affect or change the fusing temperature of the matrix polymer so that the fusing temperature of the polyblend made by combining the matrix polymer and the block copolymer also generally ranges from about 100° to 250° C. Preferably, toner particles prepared from the polyblends of the present invention have a relatively high keeping temperature, for example, higher than about 50° C., so that the toner powders can be stored for relatively long periods of time at fairly high temperatures without having individual particles agglomerate and clump together.

As mentioned previously, the properties of the described matrix polymers are improved in accordance with the present invention by blending them with a vinyl di-block or tri-block copolymer, i.e., of the AB or ABA type. These polymers are elastomeric thermoplastic polymers or thermoplastic rubber polymers. They are block copolymers with hard polystyrene segments combined with soft elastomeric segments. They form a pseudo cross-link structure by chain entanglement with the linear or branched matrix polymer when homogeneously blended therewith. The homopolymer block A is compatible with the matrix polymer and the B block is a rubbery block which is incompatible therewith. The compatible blocks A entangle with the chains of the matrix polymer and anchors the copolymer to the matrix polymer while the incompatible rubbery blocks are dispersed in a plurality of domains throughout the matrix polymer and form a separate rubbery phase which contributes to the high melt elasticity and reduced brittleness of the blend. By incompatible, it is meant that the matrix polymer and the soft elastomeric segments of the AB or ABA type copolymers are not completely soluble in each other and form two distinct phases with the soft elastomeric segments being dispersed throughout the matrix polymer in a plurality of discrete domains. In general, the average domain size of the soft elastomeric segment or component is 500 Angstroms, more generally from about 200 Angstroms to 5,000 Angstroms. It is important that when the matrix polymer is a vinyl polymer that the vinyl polymer have a number average molecular weight of at least 3,000 and that when the matrix polymer is a polyester that the polyester have a number average molecular weight of at least 2,000. This is to insure that the chain length of the matrix polymer is sufficiently long enough to cause chain entanglement of the matrix polymer with the block copolymer when they are blended together.

The specific polymers used in the practice of the present invention include:

linear styrene-isoprene-styrene tri-block copolymers, linear styrene-ethylene-butylene-styrene tri-block copolymers, linear styrene-butadiene-styrene tri-block copolymers, linear styrene-isoprene di-block copolymers, linear styrene-ethylene-propylene di-block copolymers and linear styrene-butadiene di-block copolymers. These polymers are available commercially from Shell Chemical Company (Houston, Texas) and are designated generally as Kraton polymers. The linear styrene-isoprene-styrene tri-block copolymers and the linear styrene-isoprene di-block copolymers are designated as Kraton D series products and the linear styrene-ethylene-butylene-styrene tri-block copolymers and linear styrene-ethylene-propylene di-block copolymers are designated as Kraton G series products. Linear styrene-butadiene and linear styrene-isoprene di-block copolymers also are available commercially from Phillips Petroleum Company, Bartlesville, Okla. and are designated "Solprene" copolymers. The block copolymers form a two-phase system. The polystyrene and elastomeric blocks are thermodynamically incompatible.

These block structures are produced by anionic polymerization which allows for the formation of pure blocks with no tapering, precise control over the molecular weight and molecular weight distribution. The molecular weight distribution for the polymers, for example, is extremely narrow ($M_w/M_n$=about 1).

Typically, the styrene to rubber ratios (by weight) for the linear styrene-isoprene-styrene tri-block copolymers which are used in the practice of the present invention are 14/86, 22/78, 14/86 and 17/83. Typical styrene to rubber ratios for the linear styrene-ethylene-butylene-styrene tri-block copolymers are 29/71, 13/87, 32/68 and 30/70. Typical styrene to rubber ratios for the styrene-butadiene-styrene tri-block copolymers are 31/69 and 28/72. Typical styrene to rubber ratios for the styrene-ethylene-propylene di-block copolymers are 37/63 and 28/72. A typical styrene to rubber ratio for the styrene-butadiene di-block copolymers is 30/70. A typical styrene to rubber ratio for the linear styrene-isoprene di-block copolymers employed in the practice of the present invention is 10/90. In general, each block segment may consist of 100 monomer units or more and the elastomeric thermoplastic polymers which are utilized herein have a number average molecular weight ranging from about 71,000 to about 400,000 and a weight average molecular weight ranging from about 87,000 to about 300,000.

Because of its two-phase structure, the thermoplastic rubber polymers utilized in the practice of the present invention have two glass transition temperatures rather than only one as found in random copolymers. Thus, the glass transition temperature of the polystyrene component or segment of the instant polymers is about 100° C., while the glass transition temperatures of the polyisoprene, the polyethylene/propylene, polyethylene/butylene and the polybutadiene rubber segments are about −54° C., −45° C., −48° C. and −54° C., respectively.

It is preferable also to include in the toner composition a charge control agent to control the extent and stability of tribolelectric charge. Suitable charge control agents for use in toners are disclosed, for example, in U.S. Pat. Nos. 3,893,935; 4,079,014; 4,323,634; and British Pat. Nos. 1,501,065 and 1,420,839. Charge control agents are generally employed in small quantities, such as 0.1 to 3 weight percent, preferably 0.2 to 1.5 weight percent, on a total toner powder weight basis.

Another optional but preferred starting material for inclusion in the polymer composition is a colorant in the form of a pigment or dye which imparts color to the electrophotographic image fused to paper. Suitable dyes and pigments are disclosed, for example, in the aforementioned U.S. Pat. No. Re. 31,072. Colorants are generally employed in quantities of 1 to 30 weight percent, preferably 1 to 8 weight percent, on a total toner powder weight basis.

Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index volumes 1 and 2, Second Edition.

Included among the vast number of useful colorants are those dyes and/or pigments that are typically employed as blue, green, red, yellow, magenta and cyan colorants used in electrostatographic toners to make color copies. Examples of useful colorants are Hansa Yellow G (C.I. 11680), Nigrosine Spirit soluble (C.I. 50415), Chromogen Black ETOO (C.I. 45170), Solvent Black 3 (C.I. 26150), Hostaperm Pink E-02 (Hoechst-Celanese), Fuchsine N (C.I. 42510), C.I. Basic Blue 9 (C.I. 52015) and Pigment Blue 15:3 (C.I. 74160). Carbon black also provides a useful colorant.

Various kinds of other well-known addenda (e.g., release agents, such as conventionally used polysiloxanes or waxes, magnetic materials, etc.) also can be incorporated into the toners of the invention.

Typically, the matrix polymer and the di-block or tri-block copolymers described above are melt blended by conventional techniques to form a polymer composition comprising:

about 80 to about 99 weight percent of the matrix polymer and, about 1 to about 20 weight percent of the di-block or tri-block copolymer.

As noted above, up to about 3 weight percent of a charge-control agent and up to about 30 weight percent of a colorant may be melt blended into the polymer composition, if desired. These materials are preferably in the form of finely divided solid particles which are mixed and then melt blended in accordance with conventional procedures. For example, melt blending can be accomplished using a roll mill or an extruder at temperatures of 100° to 240° C., preferably 120° to 180° C., in a period of less than approximately 30 minutes.

After melt blending, the resulting polymer composition is cooled and then ground to produce toner particles. Grinding of the heat fused polymer composition can be carried out by any convenient procedure. For example, the solid blend can be crushed and then ground to a desired particle size using a fluid energy or jet mill, as described in U.S. Pat. No. 4,089,472. Conventional particle classification techniques are then used to achieve a toner particle composition having a desired size distribution.

Alternatively, a solution can be formed by dissolving the matrix polymer and the appropriate block copolymer into a common organic solvent which will dissolve both polymers such as, for example, methylene chloride and then isolating the resultant polymer solution by means of precipitation in a non-solvent for both of the polymers such as, for example, methanol, followed by drying and collecting the resultant solid. The solid product can then be melt-blended in accordance with conventional procedures and, optionally, with colorants, charge-control agents and other addenda, crushed, ground and classified to form toner particles as discussed above. The amount of solvent used will depend upon the particular polymers that must be dissolved. However, sufficient solvent must be used to dissolve both polymers.

Toner particles prepared from the polymer composition of the present invention preferably have a particle size of 2 to 25 microns, more preferably 5 to about 15 microns. Such particles have a fusing temperature of approximately 100° to 250° C., preferably from 110° to 150° C.

The polymer compositions of the present invention display melt viscosities at 150° C. and a frequency of 1 rad/sec of $4\times10^2$ to $5\times10^4$ poise as measured on a Rheometrics Dynamic Analyzer and melt elasticities of at least about $1.5\times10^2$ dynes/cm$^2$ and preferably from about $5\times10^2$ to $4\times10^4$ dynes/cm$^2$. This low melt viscosity permits the toner powders of the present invention to be used for heat fusing toned images, particularly color toned images, to clay coated lithographic paper stock or the like using a silicone rubber coated heated fuser roll operating at speeds up to about 10 ips. The high melt elasticity permits the toner powders of the present invention to resist toner off-setting and to exhibit a wider or broader offset latitude.

It has been discovered that when the matrix polymer is blended with the di-block or tri-block copolymer described above, a number of advantages result. First, the melt viscosity of the toner binders is low. This characteristic allows the use of shorter fusing times at lower temperatures and, as a result, less power is required to adhere the toner to the receiver sheet (e.g., paper). In addition, this characteristic also allows for good adhesion of the toner particles to the receiver sheet, good image clarity, good surface gloss, the elimination of light scattering voids within an image, avoidance of charring, burning or blistering of the receiver sheet and rapid process speed. Secondly, because the melt elasticity of the toner binders is high, the toner binders of the present invention remain adhered to the receiver sheet during fusion. As a result, the possibility of image off-set is minimized. In addition, because the melt elasticity of the toner binders is high, the toner binders exhibit decreased brittleness (i.e., increased toughness), high keeping temperatures and broader fusing latitudes.

The following examples provide a further understanding of the invention.

EXAMPLES

EXAMPLES 1–15

Polyblends of a matrix polymer and various linear di-block and tri-block copolymers utilized in the practice of the present invention were prepared by conventional solution blending and melt compounding techniques. The polyblends of Examples 1 through 12 were prepared by dissolving the matrix polymer and the di-block and tri-block copolymers indicated in Table I below in methylene chloride and then precipitating out the polyblend from methanol. The polyblends of Examples 13, 14 and 15 were prepared by blending the matrix polymer and the tri-block copolymers indicated in Table I below with a two-roll mill at 100° to 150° C. for 20 minutes and then allowing the blend to cool. In all compositions, the matrix polymer was a poly (styrene-co-butyl acrylate) copolymer. In Examples 1 through 12 the weight ratio of styrene to butyl acrylate was 75/25. In Examples 13, 14 and 15 it was 80/20. The resulting compositions including the styrene to rubber ratios (weight ratios) for the di-block and tri-block copolymers, are shown below in Table I.

TABLE I

| EXAMPLE | DI-BLOCK OR TRI-BLOCK COPOLYMER | WEIGHT RATIO OF MATRIX POLYMER TO DI-BLOCK OR TRI-BLOCK COPOLYMER |
|---|---|---|
| 1. | NONE | 100/0 |
| 2. | styrene-ethylene-butylene-styrene (29/71) tri-block | 95/5 |
| 3. | styrene-ethylene-butylene-styrene (29/71) triblock | 90/10 |
| 4. | styrene-ethylene-butylene-styrene (13/87) triblock | 95/5 |
| 5. | styrene-ethylene-butylene-styrene (13/87) tri-block | 90/10 |
| 6. | styrene-butadiene (66/34) di-block | 95/5 |
| 7. | styrene-butadiene (66/34) di-block | 90/10 |
| 8. | styrene-butadiene (69/31) di-block | 90/10 |
| 9. | styrene-butadiene (70/30) di-block | 90/10 |
| 10. | styrene-butadiene (70/30) di-block | 90/10 |
| 11. | styrene-butadiene (70/30) di-block | 95/5 |
| 12. | styrene-ethylene-butylene-styrene (32/68) tri-block | 90/10 |
| 13. | NONE | 100/0 |
| 14. | styrene-ethylene-butylene-styrene (29/72) tri-block | 90/10 |
| 15. | styrene-ethylene- | 90/10 |

TABLE I-continued

| EXAMPLE | DI-BLOCK OR TRI-BLOCK COPOLYMER | WEIGHT RATIO OF MATRIX POLYMER TO DI-BLOCK OR TRI-BLOCK COPOLYMER |
|---|---|---|
| | butylene-styrene (32/68) | |

The toner property most useful in describing fusing performance is melt viscosity. In order to achieve high image quality, the toner surface must become glossy, and toner must flow together to eliminate air interfaces and light scatter. This requires as low a melt viscosity as possible. High speed fusing also requires low melt viscosity as does fusing on clay-coated paper without blistering. However, low melt viscosity can lead to toner offset onto fuser rolls and wraps and jams in the fuser. Higher melt elasticity in dynamic theological measurements can be quantified by a value know as the loss tangent, or tan δ, which is the ratio of the viscous modulus to the elastic modulus. The lower the tan δ is, the higher the melt elasticity. Thus, a toner has desirable rheological properties when melt viscosity is low and tan δ is low. Table II below summarizes the rheological data for the polyblends of Examples 1–15, as measured with a Rheometrics Dynamic Analyzer at 150° C. and a frequency of 1 rad/sec.

TABLE II

| SAMPLE | MELT VISCOSITY η (POISE) | MELT ELASTICITY G' (DYNES/CM$^2$) | TAN δ |
|---|---|---|---|
| EXAMPLE 1 | $4.30 \times 10^2$ | $3.11 \times 10^1$ | 13.87 |
| EXAMPLE 2 | $8.12 \times 10^2$ | $2.4 \times 10^2$ | 5.96 |
| EXAMPLE 3 | $3.65 \times 10^3$ | $6.60 \times 10^2$ | 5.43 |
| EXAMPLE 4 | $1.45 \times 10^3$ | $2.42 \times 10^2$ | 5.76 |
| EXAMPLE 5 | $2.50 \times 10^3$ | $8.13 \times 10^2$ | 3.08 |
| EXAMPLE 6 | $1.23 \times 10^3$ | $1.30 \times 10^2$ | 9.44 |
| EXAMPLE 7 | $2.08 \times 10^3$ | $5.11 \times 10^2$ | 3.94 |
| EXAMPLE 8 | $2.70 \times 10^3$ | $4.0 \times 10^2$ | 6.51 |
| EXAMPLE 9 | $4.61 \times 10^3$ | $1.68 \times 10^3$ | 2.55 |
| EXAMPLE 10 | $5.76 \times 10^3$ | $3.76 \times 10^3$ | 1.16 |
| EXAMPLE 11 | $3.03 \times 10^3$ | $1.40 \times 10^3$ | 1.92 |
| EXAMPLE 12 | $2.31 \times 10^3$ | $1.84 \times 10^2$ | 10.5 |
| EXAMPLE 13 | $2.3 \times 10^3$ | $2.1 \times 10^1$ | 97.9 |
| EXAMPLE 14 | $2.63 \times 10^4$ | $1.39 \times 10^4$ | 1.74 |
| EXAMPLE 15 | $1.47 \times 10^4$ | $7.66 \times 10^3$ | 1.64 |

As shown in Table II, the polyblends greatly raise the melt elasticity over that of the matrix polymer alone, while at the same time maintaining a low melt viscosity.

EXAMPLE 16

Toner materials were prepared by blending 90 parts by weight of a matrix polymer of a poly (styrene-co-butyl acrylate) copolymer (80/20) with 10 parts by weight of a linear styrene-ethylene-butylene-styrene (29/71) tri-block copolymer, 1 part by weight charge-control agent and 6 parts by weight colorant. This was done by adding 45 g of the matrix polymer; 5 g of the tri-block copolymer, 3 g of Regal 300 pigment (a trademark for a carbon black colorant sold by Cabot Corporation) and 0.5 g of N-octadecyl-N,N-dimethylbenzylammonium m-nitrobenzenesulfonate charge-control agent to a two-roll mill with a roll temperature of 150° C. and melt compounding the composition at 150° C. for 20 minutes.

The toner material was then cooled to room temperature, coarse ground on a Wiley™ mill with a 2 mm screen. The coarse ground powder was then jet milled to toner particle size on a Trost model TX fluid energy mill at a pressure of 70 psi and a 1 gm/min feed rate. The resulting particle size was 8–10 microns volume median diameter as determined on a Coulter Counter and exhibited a melt viscosity of $2.36 \times 10^3$ poise at 150° C. and a frequency of 1 rad/sec as measured on a Rheometrics Dynamic Analyzer, a melt elasticity of $3.94 \times 10^3$ dynes/cm$^2$ and a tan δ of 0.63.

The invention has been described in detail with particular reference to preferred embodiments thereof, but it will be understood that variations and modifications can be effected within the spirit and scope of the invention.

We claim:

1. A thermoplastic polymer composition comprising a homogeneous blend of (a) a major amount of a linear or branched matrix polymer, said polymer being a polyester having a number average molecular weight of at least 2,000 or a vinyl polymer having a number average molecular weight of at least 3,000, and (b) a minor amount of a block copolymer of AB or ABA type wherein A is a homopolymer block which is compatible with said matrix polymer and B is a homopolymer block which is incompatible with said matrix polymer, said blend having a fusing temperature of not more than 250° C., a melt viscosity of from about $4 \times 10^2$ to $5 \times 10^4$ poise as measured on a Rheometrics Dynamic Analyzer at 150° C. and a frequency of 1 rad/sec and a melt elasticity of from about $1.5 \times 10^2$ to $4 \times 10^4$ dynes/cm$^2$.

2. A composition according to claim 1, wherein said blend has a fusing temperature of from about 100° to 250° C.

3. A composition according to claim 1, wherein said blend has a melt elasticity of from about $5 \times 10^2$ to about $4 \times 10^4$ dynes/cm$^2$.

4. A composition according to claim 1, wherein the polyester has a number average molecular weight of from 2,000 to 20,000.

5. A composition according to claim 1, wherein the vinyl polymer has a number average molecular weight of from 3,000 to 50,000.

6. A composition according to claim 1, comprising from about 80 to 99 weight percent of the matrix polymer and from about 1 to about 20 weight percent of the block copolymer.

7. A composition according to claim 6, wherein said matrix polymer is a poly(styrene-co-butyl acrylate) copolymer.

8. A composition according to claim 6, wherein said matrix polymer is a polyester.

9. A composition according to claim 8, wherein said polyester is the reaction product of at least one carboxylic acid monomer and at least one alcohol wherein most of the alcohol and the carboxylic monomers have a functionality of less than three.

10. A composition according to claim 8, wherein the polyester is derived from the polyesterification of a polymerizable monomer composition comprising:

a dicarboxoylic acid-derived component comprising 75 to 100 mole percent of dimethyl terephthalate and 0 to 25 mole percent of dimethyl glutarate and a diol/polyol-derived component comprising: 90 to 100 mole percent of 1,2-propane diol and 0 to 10 mole percent of glycerol.

11. A composition according to claim 1, wherein the block copolymer is a linear styrene-ethylene-butylene-styrene tri-block copolymer.

12. A composition according to claim 1, wherein the block copolymer is a linear styrene-butadiene-styrene tri-block copolymer.

13. A composition according to claim 1, wherein the block copolymer is a linear styrene-isoprene di-block copolymer.

14. A composition according to claim 1, wherein the block copolymer is a linear styrene-ethylene-propylene di-block copolymer.

15. A composition according to claim 1, wherein the block copolymer is a linear styrene-butadiene di-block copolymer.

16. A toner powder comprising a polymer composition according to claim 1.

17. A toner powder according to claim 16, further comprising 1 to 30 weight percent of a dispersed colorant on a 100 weight percent total toner powder composition basis.

18. A toner composition according to claim 17, further comprising 0.1 to 3 weight percent of a dispersed charge-control agent.

* * * * *